United States Patent [19]

Hunt

[11] 4,236,709

[45] Dec. 2, 1980

[54] CARTRIDGE SHEET FEED ATTACHMENT

[75] Inventor: Ronald E. Hunt, Austin, Tex.

[73] Assignee: International Business Machines Corporation, Armonk, N.Y.

[21] Appl. No.: 53,462

[22] Filed: Jun. 29, 1979

[51] Int. Cl.[3] ..... B65H 3/30

[52] U.S. Cl. ..... 271/21; 271/37; 271/110; 271/113; 271/117; 271/121

[58] Field of Search ..... 271/21, 109, 37, 110, 271/111, 113, 118, 119, 121

[56] References Cited

U.S. PATENT DOCUMENTS

| | | | |
|---|---|---|---|
| 3,298,682 | 1/1967 | Gatti | 271/4 |
| 3,430,748 | 3/1969 | Purri | 197/130 |
| 3,671,719 | 6/1972 | May | 235/61.11 D |
| 3,917,258 | 11/1975 | Miller | 271/9 |
| 4,089,402 | 5/1978 | Hyland | 400/625 |

OTHER PUBLICATIONS

IBM Technical Disclosure Bulletin, vol. 21, No. 12, May 1979, pp. 4753, 4754.

IBM Technical Disclosure Bulletin, vol. 21, No. 7, Dec. 1978, p. 2616.

IBM Technical Disclosure Bulletin, vol. 19, No 10, Mar. 1977, p. 3630.

IBM Technical Disclosure Bulletin, vol. 19, No.10, Mar. 1977, p. 3628.

*Primary Examiner*—Richard A. Schacher

*Attorney, Agent, or Firm*—Andrea P. Bryant

[57] ABSTRACT

Disclosed is a compact sheet feed apparatus suitable for attachment to a printer or the like, including a removable cartridge for holding a stack of sheets. The cartridge provides an intergral edge aligner surface and second sheets restraint during lateral shingling of sheets prior to feeding in a direction transverse to shingling.

8 Claims, 7 Drawing Figures

CARTRIDGE SHEET FEED ATTACHMENT

BACKGROUND OF THE INVENTION

1. Field of the Invention

This invention relates to sheet feeding. More particularly, it relates to compact sheet feed apparatus for attachment to a printer, wherein sheets are shingled in a direction perpendicular to the feed direction while providing positive second sheet restraint.

2. Prior Art

In the prior art, shingling usually occurs in the direction in which sheets are to be fed. Picker means are provided for removing a sheet once its edge is separated. When space is not limited such a system is adequate. When it is desired to have a compact sheet feed attachment, however, conventional sheet separation by shingling proves too bulky and mechanically complex. Means are needed to either raise the stack as it is depleted or to lower the feed mechanism. Further, the requirement of second sheet restraint mechanisms also adds complexity.

OBJECTS OF THE INVENTION

It is an object of this invention to provide a compact, light weight, sheet feed apparatus for separating sheets in a direction perpendicular to the feed direction.

It is a further object of this invention to provide an improved sheet feed apparatus wherein sheet separation occurs with no need for stack elevation.

It is another object of the present invention to provide an improved sheet feed attachment for printers.

Another object of this invention is to provide apparatus for aligning and feeding sheets in an improved manner.

SUMMARY

The present invention provides a compact, simplified structure attachable to a printer, or the like, in such manner as to overcome gravitational force to retain the stack during shingling in a direction transverse to the feed direction. The apparatus of the instant invention includes a removable cartridge for holding a stack of sheets to be fed. Integral with the cartridge is an edge aligning surface and positive second sheet restraint means. The cartridge is designed with a sloped side wall leading to the edge aligning surface. The coaction of the sheet separator shingler and this sloped wall eliminates the need for elevating means as the stack is depleted.

The removable cartridge connects to a frame which is mountable on a printer at the extreme ends of the platen. The separator feed mechanism is mounted on the left hand side of the frame. Thus the size of the feed mechanism is independent of sheet size. That is, the separator feed mechanism works on only a small area of a sheet so that any size cartridge may be used therewith. Within the scope of this invention, a different cartridge for each sheet size or a cartridge adjustable in size may be used. A further advantage arises from the design of the apparatus to operate on only a small portion of a sheet. Composite forms, i.e., multipart snap apart forms bound adjacent a margin, may also be fed. The separator included in the apparatus contacts only the bound stub of the composite form, thus enabling such forms to be separated and fed in the same manner as single sheets.

The foregoing and other objects and advantages of the present invention will become apparent from the following more particular description of a preferred embodiment as illustrated in the accompanying drawing.

DESCRIPTION OF THE PREFERRED EMBODIMENT

Figure 1:
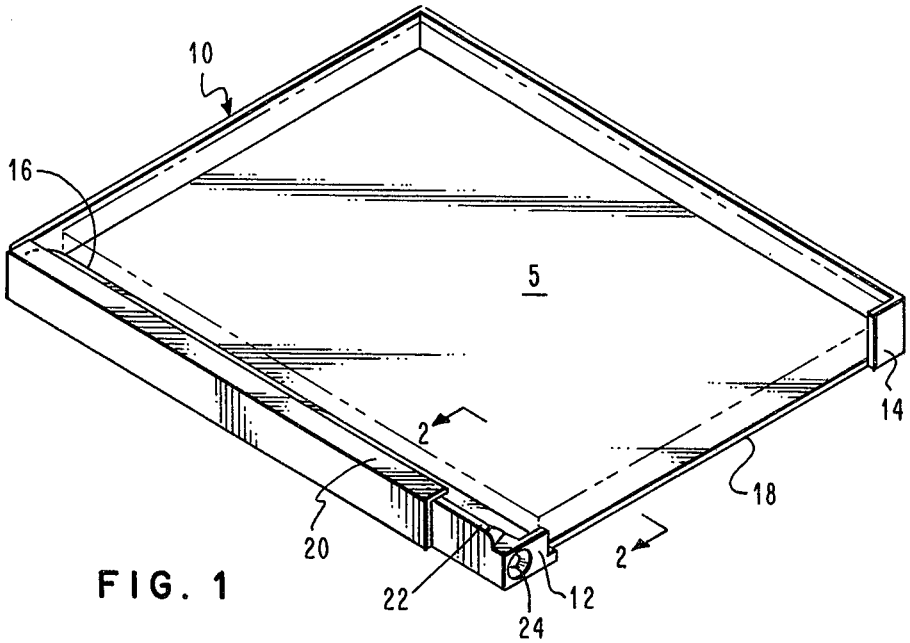
FIG. 1 shows the paper cartridge with a stack of sheets therein.

Referring now to FIG. 1, a stack 5 of sheets is shown in cartridge 10. Cartridge 10 includes bottom stack retaining wall portions gates 12 and 14 for retaining stack 5 against gravitational forces when the cartridge is mounted for use. Side wall 16 is sloped away so as to form an angle of about 45 degrees with the cartridge base 18. The structure of sidewall 16 is advantageous in that it eliminates the need for more complex stack elevating means as will become evident later in the description. It is not necessary that sidewall 16 be at such angle for its entire length. Rather it is important only in the area shown in FIG. 2. Sheets travel ramped sidewall 16 to edge aligner 20. Sidewall 16 terminates at guide 20 which is parallel with cartridge base 18. Guide 20 is not coextensive in length with side wall 16. That portion of side wall 16 which extends beyond guide 20 serves as a backup surface 22 for a conical feed roller (FIG. 3) during sheet feeding in the direction perpendicular to the shingling direction.

Figure 2:
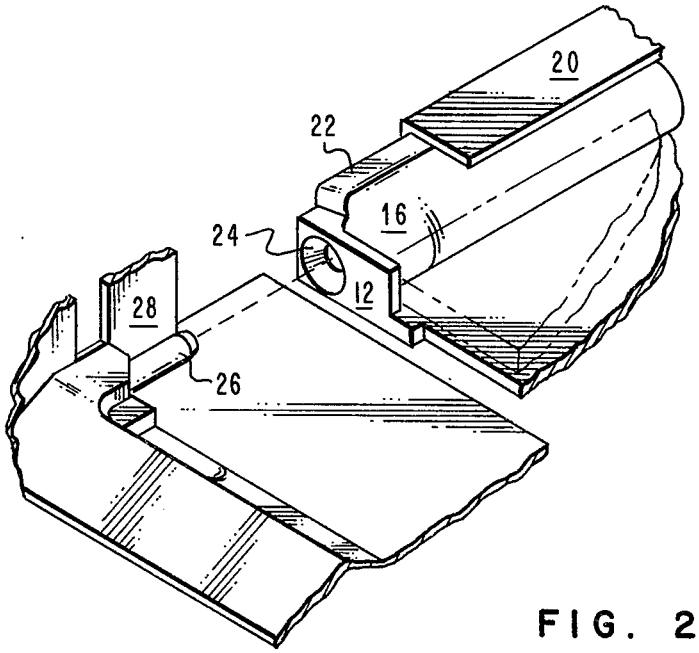
FIG. 2 is an exploded portion of the cartridge of FIG. 1.

FIG. 2 is an enlarged view of the lower left hand portion of cartridge 10 in FIG. 1 and frame portion 28. Backup surface 22 for conical feed roller can be more clearly seen. In cartridge end wall including retaining gate 12 is aperture 24 provided to receive aligning pin 26 when cartridge 10 is mounted onto frame 28. This is the only connection for cartridge 10 to frame 28. Thus any cartridge size may be used with the present apparatus, requiring only a properly located aperture 24.

Figure 3:
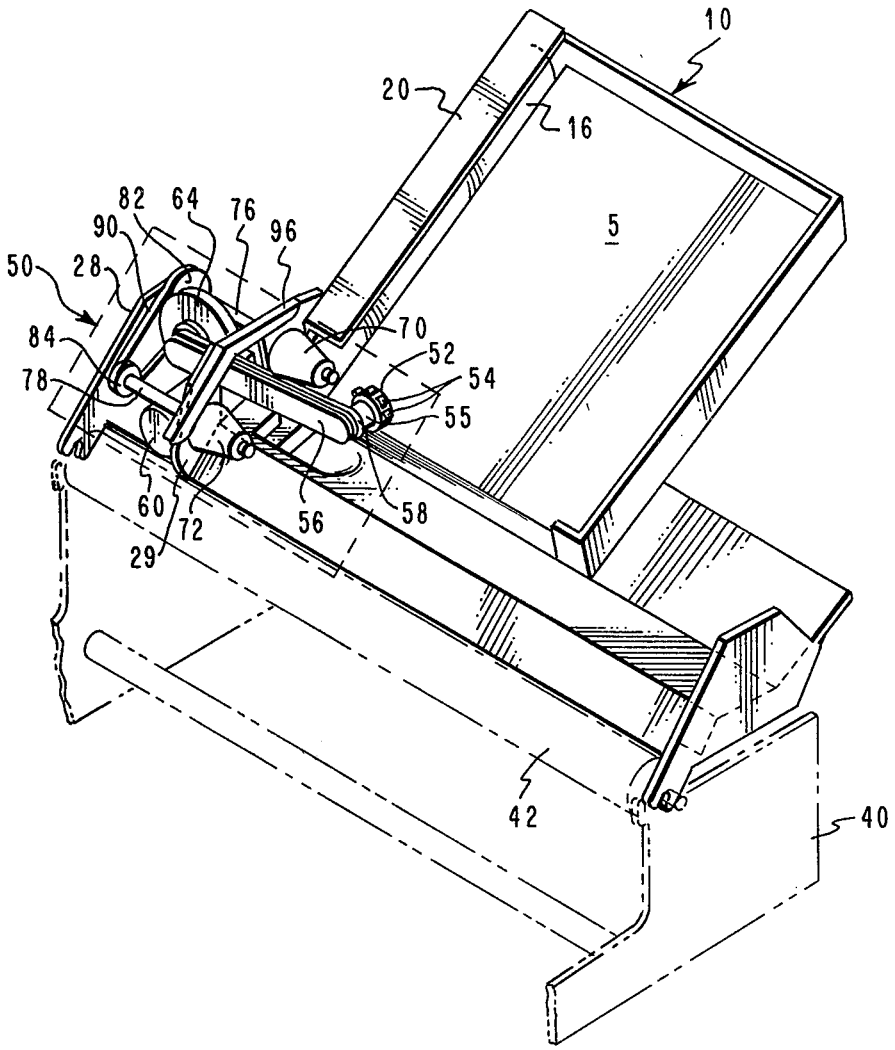
FIG. 3 shows the apparatus of the invention mounted on a printer.
Figure 4:
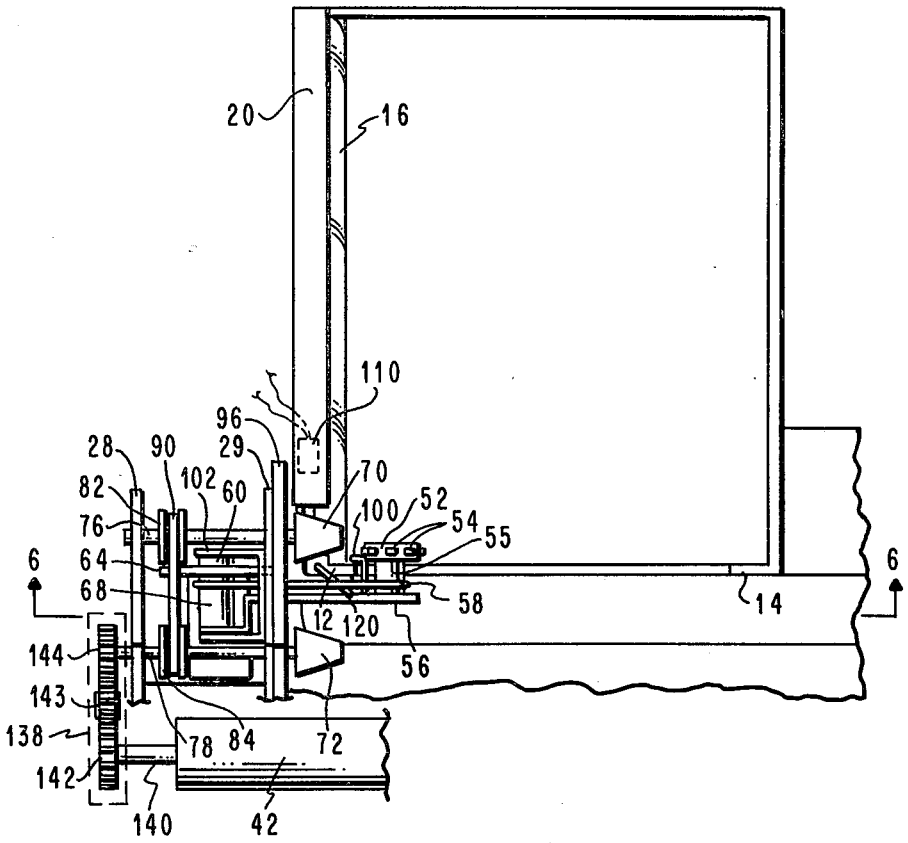
FIG. 4 is a top view of the cartridge and feed mechanism of the present invention.

FIG. 3 shows a perspective view of frame 28 of the present invention attached to frame 40 of a printer at either end of platen 42. Mounted on frame 28 are cartridge 10 and separator feed mechanism indicated generally as 50. Shingler wheel 52 is provided for separating sheets from stack 5. Shingler wheel 52 has free rolling rollers 54, the axis of rotation of which are parallel to the axis of rotation of wheel 52, evenly spaced about its periphery. Shingler wheel 52 is connected via shaft 55 to arm 56 for movement into and out of contact with stack 5. Shingler wheel 52 is driven through belt 58 by DC motor 60 (FIG. 4).

Arm 56 is moved into and out of contact with stack 5 by DC motor 60 (FIG. 4) whose output shaft 62 drivingly engages friction wheel 64. The torque of the internal friction clutch is used to lower and hold down arm 56 and thus shingler wheel 52 in its position of contact with stack 5.

Separator feed mechanism 50 additionally is provided with conical feed rollers 70 and 72 for driving a sheet in a direction 90° to that of separation. Conical feed rollers 70 and 72 are rotatably mounted on shafts 76 and 78 respectively. Shaft 76 is mounted in frame 28 and is freely rotatable. Shaft 78 goes through frame 28 and is connected through gear train 138 (FIG. 4) to platen 42. Pulleys 82 and 84 are mounted on shafts 76 and 78 respectively. Timing belt 90 is provided to keep pulleys 82 and 84 and thus conical rollers 70 and 72 synchronized. As is well known in the art, conical rollers perform the dual function of feeding and aligning sheets.

Also shown in FIG. 3 is frame piece 96 adjacent conical feed roller 72. Frame piece 96 is provided as a sheet exit guide. Although not shown, it is within the scope of my invention to include a receptacle for printed, or otherwise operated upon, sheets. In that event, or even if sheets are removed one by one manually, frame piece 96 cooperates in exiting sheets with conical feed roller 72. That is, sheet is driven away from the platen and between conical roller 72 and frame piece 96 in a manner similar to that disclosed in U.S. Pat. No. 3,671,719 to G. H. May, assigned to the same assignee as the present invention.

FIG. 4 is a top view of the apparatus of FIG. 3 and more clearly shows the driving means for the sheet separator and feeder of the present invention.

Arm 56 carrying shingler wheel 52 is also provided with sheet hold down member 100 to help sheet below top edge of gate 12. Hold down member 100 is fixedly attached to arm 56 for movement therewith.

Arm 56 is mounted in U-shaped bracket 102 (FIG. 6) and pivotable about shaft 66. Arm 56 is drivingly connected to DC motor 60, in a manner to be described below with reference to FIG. 5, for raising and lowering arm 56. DC motor 60 is energized by a feed signal from the printer (not shown) to cause its output shaft 62 to rotate in a first direction. Friction wheel 64 tangentially contacts DC motor output shaft 62 which causes friction wheel 64 to also rotate. Friction wheel 64 is fixedly attached to shaft 66 which is part of the mechanism for driving endless belt 58. Belt 58 also travels around shaft 55, thereby drivingly connecting shafts 66 and 55. The just described driving means will be discussed in more detail below with reference to FIG. 5.

Sensor 110 is positioned near conical roller 72 and is provided for determining when the topmost sheet has reached edge aligner 20. Sensor 110 is also connected to DC motor 60 in order to supply a signal which causes DC motor 60 to reverse its drive direction and thereby lift arm 56 as will be explained below with reference to FIG. 5. Not shown in FIG. 4, but located in frame piece 29 is 2 stop for limiting upward motion of arm 56.

Gear train 138 referenced in connection with FIG. 3 for drivingly connecting platen 42 and conical rollers 72 and 74 for rotation in the same direction and sychronizing their speed is shown in FIG. 4. Mounted on platen shaft 140 is gear 142. Idler gear 143 is provided between gear 142 and gear 144 mounted on shaft 78 on which conical roller 74 is mounted. As stated in connection with FIG. 3, belt 90 drivingly connects pulley 84 on shaft 78 to pulley 82 on shaft 76.

Figure 6:
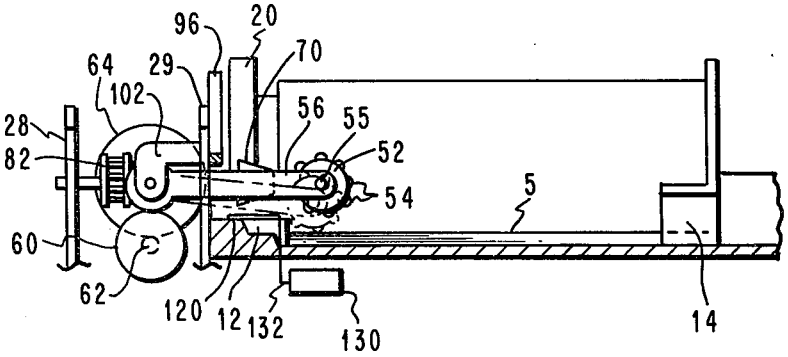
FIG. 6 is a front view of the apparatus shown in FIG. 4.
Figure 5:
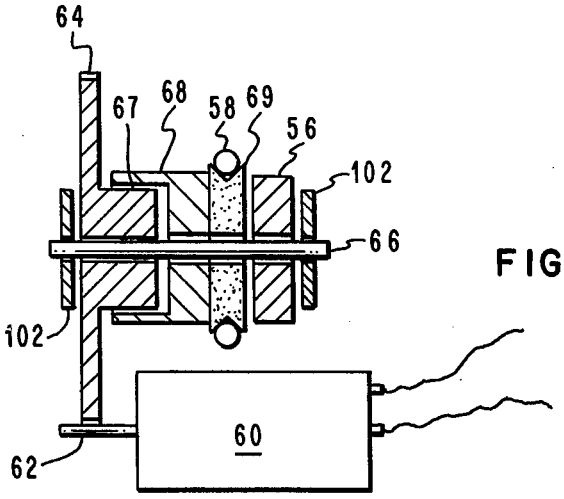
FIG. 5 is a partial section view of the drive mechanism for the shingler wheel assembly of the present invention.

FIG. 5 is a partial sectional view of the driving connection between DC motor 60 and shingler wheel 52. Output shaft 62 from DC motor 60 drivingly engages friction wheel 64 which is fixedly mounted on shaft 66. Shaft 66 is rotatably mounted at either end of U-shaped bracket 102 (FIG. 6). Hub 67, fixedly mounted on shaft 66, is provided to cooperate with friction clutch 68. Clutch 68 is part of a subassembly which includes V-pulley 69 about which endless drive belt 58 travels. Arm 56 is pivotably mounted on shaft 66 adjacent to the just mentioned subassembly. It will be recalled that shaft 55 is rotatably mounted in the opposite end of arm 56. Drive belt 58 connects shafts 66 and 55. Suitable bearing material is provided between shaft 66 and clutch 68 and V-pulley 69. Likewise, there is provided suitable bearing material between shaft 66 and arm 56 to permit arm 56 to pivot downwardly to enable shingler wheel 52 to contact stack 5.

Having reference now to FIG. 6, which is a front view of the apparatus of FIG. 4, lift arm 120 is provided to move a sheet over retaining 12 can be seen. Arm 56 is shown in phantom in its position contacting stack 5. Lift arm 120 is mounted for rotation in a bearing in frame 28 so that when cartridge 10 is attached to frame 28, lift arm 120 is adjacent stack retaining gate 12. Lift arm 120 is caused to rotate by solenoid 130 which is actuated by sensor 110. Plunger 132 of solenoid 130 contacts one end of lift arm 120.

Figure 7:
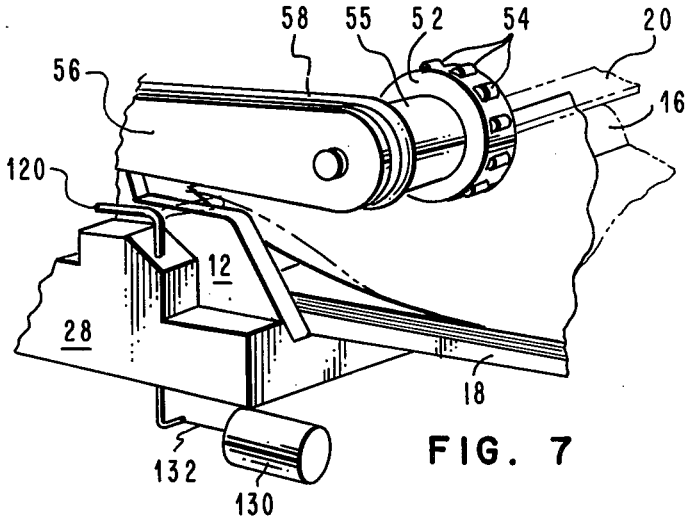
FIG. 7 is a view of the apparatus similar to that in FIG. 5 showing in more detail the passage of a sheet over one retaining gate.

FIG. 7 is a front view of the apparatus similar to FIG. 6. Arm 56 is shown in its raised position after the topmost sheet has been separated from stack 5. Lift arm 120 is shown in solid lines in its original position and in phantom lines in its position after rotation. It can be seen that lift arm 120 is interposed between the sheet and retaining gate 12, thereby freeing the sheet for entry into platen feed path, driven by conical rollers 72 and 74.

The dimensions of cartridge 10 and sheets in stack 5 are such that once a sheet is under conical roller 72 it is also clear of retaining gate 14, and thus free to be fed to the platen by conical rollers 72 and 74. This distance between guide 20 and the edge of retaining 14 must be equal to the width of the sheets to be fed from the cartridge in order for retaining gate 14 to properly perform its intended function of positive second sheet restraint. When a stack of sheets is subjected to shingling, the top sheet is most displaced from its original stacked position. The top sheet travels toward guide 20, is caught between conical roller 72 and backup surface 22 and clears retaining gate 14. Arm 120 lifts the corner of the sheet over retaining gate 12 and the top sheet is fed toward the platen. The second and lower sheets, however, have not cleared gate 14 and thus are restrained against feeding toward the platen.

Referring back to FIGS. 1 and 6 it will be appreciated that the design of cartridge 10 cooperates with arm 56 to eliminate a requirement for stack elevation as the stack is depleted. Arm 56 is movable downwardly far enough for shingler wheel 52 to contact sheet or sheets stack 5 on cartridge base 18. Ramped side wall 16 provides an upward path to edge aligner 20.

Operation

Referring once again to FIGS. 3, 4, 5, and 7, in operation of the apparatus of the present invention, user places stack 5 in cartridge 10. Stack 5 is restrained against gravity by gates 12 and 14. Arm 56 carrying shingler wheel 52 and sheet hold down member 100 is in its inoperative position. Upon receipt of a feed signal from the printer by DC motor 60 the following sequence of events occur. DC motor 60 starts up causing its shaft 62 to rotate. Friction wheel 64, in tangential contact with motor output shaft 62 begins to rotate, shaft 66 rotates therewith. Friction clutch 68 contacts hub 67; thus, V-pulley 69 and arm 56, comprising a subassembly with friction clutch 68 pivot clockwise bringing shingler wheel 52 into contact with stack 5. At the same time belt 58 is driven clockwise, causing shaft 55 to rotate. Thus shingler wheel 52 is rotation when contact with stack 5 is made. At this point in time, friction clutch 68 slips and downward motion of arm 56 ceases.

The topmost sheets are shingled as a result of contact by free rolling rollers 54 on shingler wheel 52 toward cartridge sidewall 16. The top sheet is driven up to guide 20.

Sensor 110 detects the presence of one sheet as it enters beneath conical roller 72 which rotates at platen speed. The sheet is driven in a direction perpendicular to the shingling direction between conical roller 72 and backup portion 22 and conical roller 74. A signal from sensor 110 indicates that a sheet is present and causes DC motor 60 to reverse the direction of rotation of its shaft 62. Accordingly friction wheel 64 rotates in counterclockwise direction, as does shaft 66. Clutch 68 contacts hub 67 thereby imparting counterclockwise rotation in arm 56. Arm 56 travels upwardly until it hits a stop in frame 28.

Also in response to the signal from sensor 110, solenoid 130 is actuated. Plunger 132 causes arm 120 to rotate in its bearing 122 in frame 28. As arm 120 rotates it lifts the corner of the sheet over retaining gate 12. Solenoid 130 is subject to a time delay sufficient for cone roller 72 to move the sheet forward to clear gate 12. Solenoid 130 is then deactuated bringing arm 120 back to its original position when the trailing edge of the sheet clears gate 12. The sheet is driven toward the platen by the rotation of conical rollers 72 and 74. The sheet continues through its feed path around the platen in a conventional manner and exits around the outer periphery of conical roller 74 against the backup surface provided by frame piece 96.

Although the invention has been shown and described using a fixed wall cartridge, it will be understood by those skilled in the art that the walls may be adjustable as long as the proper relationship between the width of the sheets to be fed and the distance between guide 20 and the inner edge of retaining gate 14 is maintained.

Further, in the described preferred embodiment, sheet cartridge 10 is shown mounted at an angle which is almost vertical with the printer. This is for operator convenience in loading and removing the cartridge. The sheet separation and feed technique as disclosed may also be used when the cartridge is in position at another angular relationship to the printer or like utilization device.

While the invention has been particularly shown and described with reference to a preferred embodiment it will be understood by those skilled in the art the above described and various other changes in form and detail may be made without departing from the spirit and scope of the invention.

What is claimed is:

1. Sheet feed apparatus comprising:

a sheet stack receptacle holding a stack of sheets in a position in which they are gravitationally urged in the direction in which they are to be fed;

first and second stack restraining means against which said gravitationally urged sheets abut;

means for moving the uppermost sheet from said stack transversely of said direction of feed to a position beyond said first restraining means;

means for freeing said sheet from said second restraining means; and means for driving said sheet in said direction of feed.

2. The apparatus of claim 1 wherein said means removing said sheet transversely is a freely rotatable member which is peripherally engaged with said uppermost sheet urged linearly in said transverse direction.

3. The apparatus of claims 1 or 2 wherein said sheet stack receptacle includes an integral edge alignment guide for said uppermost sheet transversely moved.

4. The apparatus of claim 3 wherein the distance between said integral edge alignment guide for said uppermost sheet and said first restraining means equals the width of said sheets.

5. Apparatus for feeding sheets in a stack seriatim to a utilization device comprising:

a frame adapted for connection to said utilization device;

a cartridge connectable to said frame for holding the stack oriented in the direction of the utilization device;

means integral with said cartridge restraining stack movement in the direction of said utilization device;

edge aligning means integral with said cartridge;

selectively operable shingling means connected to said frame for separating the topmost sheet in a direction transverse to the direction of the utilization device;

means connected to said frame for urging said topmost sheet against said edge aligning means;

means connected to said frame for removing only said topmost sheet from said means for restraining; and means connected to said frame for feeding said topmost sheet in the direction of the utilization device.

6. The apparatus of claim 5 further including sensor means for detecting when said topmost sheet has reached said means for urging said topmost sheet against said edge aligning means and outputting a signal;

and means responsive to said signal connected to said selectively operable shingling means for terminating shingling.

7. The apparatus of claims 5 or 6 wherein said means for urging and means for feeding are drivingly connected to sheet advancement means in said utilization device.

8. The apparatus of claim 5 wherein said selectively operable shingling means includes:

a cylindrical wheel having spaced about its periphery free rolling rollers whose axes of rotation are parallel to the axis of rotation of the cylindrical wheel;

said cylindrical wheel being rotatably connected to an arm pivotably connected to said frame;

a motor mounted on said frame and drivingly connected to said wheel and to said arm through a slip clutch whereby energizing said motor in a first direction rotates said wheel and pivots said arm downward and reversing said motor raises said arm.

* * * * *